United States Patent [19]

Ahroni

[11] Patent Number: 4,678,257

[45] Date of Patent: Jul. 7, 1987

[54] MULTIPLE-SOCKET END CONNECTOR FOR EXTENSION CORDS

[76] Inventor: Joseph M. Ahroni, 2701 W. Manor Pl., #204, Seattle, Wash. 98199

[21] Appl. No.: 865,795

[22] Filed: May 27, 1986

Related U.S. Application Data

[63] Continuation-in-part of Ser. No. 755,230, Jul. 17, 1985.

[51] Int. Cl.[4] ..... H01R 19/28

[52] U.S. Cl. ..... 439/426; 439/686

[58] Field of Search ..... 339/99 R, 191 R, 191 M, 339/192 R, 206 R, 207 R, 208, 210 R, 210 M, 44 R, 44 M, 191 A, 193 R, 193 N, 193 US

[56] References Cited

U.S. PATENT DOCUMENTS

| | | | |
|---|---|---|---|
| 2,717,365 | 9/1955 | Greenbaum | 339/99 R |
| 2,810,895 | 10/1957 | Odegaard | 339/99 R |
| 2,932,000 | 4/1960 | Buchanan | 339/191 R |
| 2,932,811 | 4/1960 | Abraham et al. | 339/44 R |
| 3,876,273 | 4/1975 | Schwartz | 339/44 R |
| 4,108,527 | 8/1978 | Douty et al. | 339/59 M |
| 4,160,576 | 7/1979 | Vettori | 339/119 R |
| 4,250,349 | 2/1981 | Bennett | 339/44 R |
| 4,354,727 | 10/1982 | Brown | 339/192 R |
| 4,408,813 | 10/1983 | Koehler | 339/44 R |

*Primary Examiner*—Gil Weidenfeld
*Assistant Examiner*—Gary F. Paumen
*Attorney, Agent, or Firm*—Seed and Berry

[57] ABSTRACT

An electric multiple-socket end connector has registering housing shells which present sets of openings for receiving plug blades and interlock when pressed together by way of flexible legs with locking feet on one of the shells which pass through passages in the other shell. These legs deflect while the feet pass through the passages whereupon the legs spring back causing the feet to snap into locking position. The housing shells present a central wireway between two conductor plates registering in the housing shells with sets of openings for receiving plug blades. These plates have extensions presenting cord piercing contact barbs to make electrical contact with the wire leads in an insulated cord held in the wireway when the housing shells are pressed together.

15 Claims, 6 Drawing Figures

FIG. 4
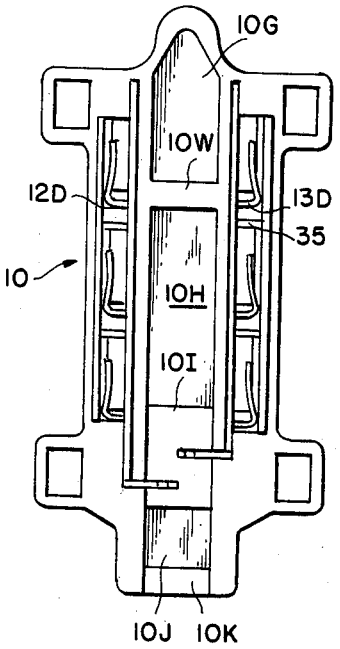
FIG. 5
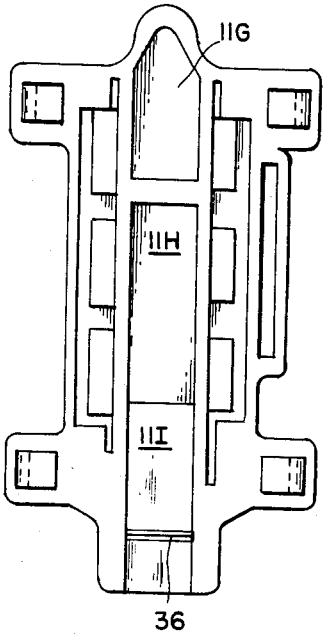
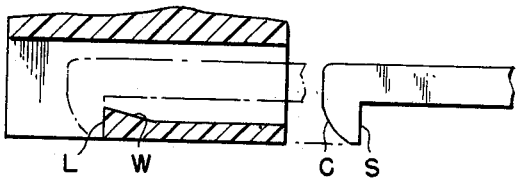
FIG. 6

MULTIPLE-SOCKET END CONNECTOR FOR EXTENSION CORDS

RELATED APPLICATION

This application is a continuation-in-part of co-pending application Ser. No. 755,230 filed July 17, 1985.

TECHNICAL FIELD

The present invention relates to multi-socketed end connectors fitted to the ends of electrical extension cords for receiving the blades of plugs from other cords.

BACKGROUND ART

This invention is an improvement over end connectors of the type which are adapted to receive blades from two plugs on one side of its housing and the blades from a single plug on the opposite side of its housing, and in which the housing is either molded in one piece or consists of two halves which are connected together by adhesive or fasteners such as screws or rivets. In the type in which the entire housing is molded in a single operation, it is necessary to count the contact members and the wire leads together and place them as a unit in the mold, which is either unduly time consuming or requires a relatively expensive and complicated loading mechanism. On the other hand, those end connectors in which the housing components are secured together with adhesive or fastening elements not only require insertion of the conductor elements and wire leads, but also require application of adhesive or fasteners.

As previously indicated, in some end connectors the assembly operation requires that the leads for the extension cord be connected to the conductor elements before the housing components are secured toether. In others, the connection to the extension cord leads has been made by use of barbs on the conductor elements which pierce the insulation of the cord when the housing components are secured together. However, full advantage has not been taken of the use of this latter type of connection for ease and speed of assembly of the end connector.

The present invention aims to provide an improved end connector of unusually simple and economical construction with a minimum of parts which can be quickly assembled without use of auxiliary fastening devices and without need to strip insulation from the wire leads of the extension cord to assemble and attach the end connector.

DISCLOSURE OF THE INVENTION

In accordance with this invention, two injection-molded housing shells which collectively provide a wireway are snap-fitted together by way of flexible legs projecting from one of the shells and passing through the other shell to interfit feet on the legs with locking shoulders presented by the other shell. While the two housing shells are being pressed together, contact barbs projecting into the wireway from contact members are forced through the cord insulation into engagement with the wire leads. The engagement points of the contact barbs with the cord is sufficiently spaced from the end of the cord so that the barbs adequately resist separation of the cord from the housing for strain relief.

Accordingly, pressing of the housing shells together accomplishes interlocking of the shells, securing of the cord relative to the housing, and making electrical contact with the cord leads.

BRIEF DESCRIPTION OF THE DRAWINGS

FIG. 4 is a top plan view of one of the housing shells shown with the contact elements in operative position;

FIG. 5 is a bottom plan view of the other housing shell; and

FIG. 6 is a detail sectional view showing the interfit of one of the housing legs.

BEST MODE FOR CARRYING OUT THE INVENTION

Figure 1:
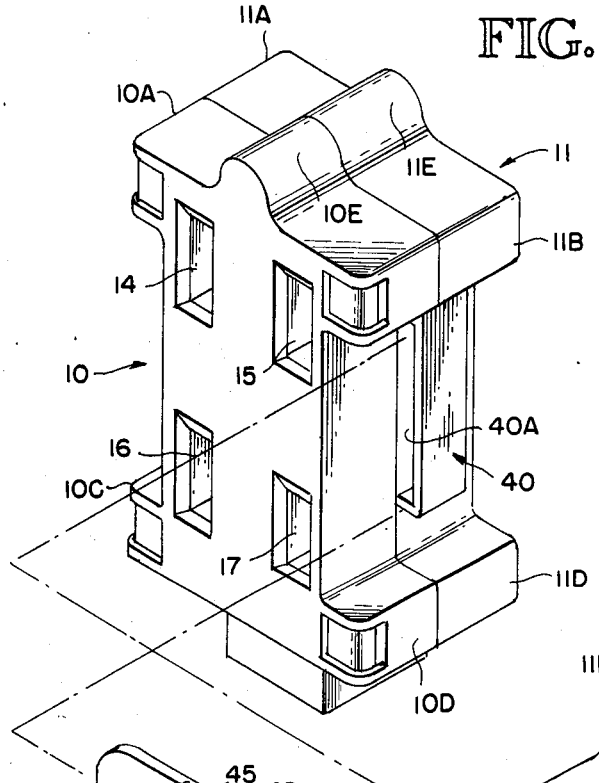
FIG. 1 is a perspective view of a connector made in accordance with the present invention, illustrating a safety element in exploded relationship to the connector.

Referring to the drawings, it is seen that the end connector comprises two interfitting housing shells 10, 11 and two conductor members 12, 13. For ease of identification, the shell 10 will be called the bottom or female shell and the shell 11 will be called the top or male shell, and the connector element 12 will be called the left connector and the other connector 13 will be called the right connector. Also, the end of the connector which receives the electrical cord will be called the rear end of the connector and the opposite end will be called the front end of the connector.

Figure 2:
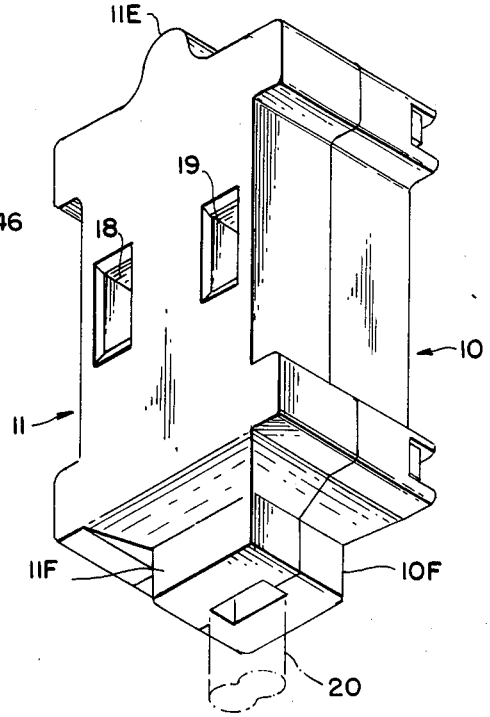
FIG. 2 is a perspective view of the connector as viewed from the extension cord end thereof.

As can be seen in FIG. 1, the bottom shell 10 is formed with sets of openings 14, 15 and 16, 17 for receiving the blades from two end plugs. For purposes of example, the openings 14 and 16 are enlarged to receive polarized blades. As shown in FIG. 2, the top housing shell 11 has a single pair of blade receiving openings, 18, 19, with the opening 18 being enlarged to receive the polarized blade.

The housing shells 10, 11 are generally rectangular and have ribs 10A–D and 11A–D extending laterally as ears at their four corners. At their forward ends the housing shells 10, 11 have matching round crown extensions 10E, 11E and at their rear ends they have matching channel extensions 10F, 11F which collectively provide an entry wireway for electrical cord 20.

Snap fitting of the housing shells 10, 11 together is accomplished by way of a head pair 22, 23 and a foot pair 24, 25 of downwardly projecting legs with respective outwardly extending locking feet 22A, 23A and 24A, 25A which fit into pairs of tapered passages 26, 27 and 28, 29 at the head and foot of the bottom shell 10. The legs 22–25 are necked from the ears 11A–D and the passages 26–29 are formed in the ears 10A–D. These passages have their outer walls W tapered inwardly from the top side of the bottom shell, and they terminate at locking shoulders L which are spaced from the inner walls of the passages a distance slightly greater than the maximum width of the locking feet from heel to toe. These feet have a front locking step at their juncture with the legs and curved cam bottoms C. When the housing shells are in top to bottom alignment, the inner edges of the locking steps, where they join the legs, are aligned with the back edges of the outer walls of the passages 26–29 where they join the locking steps. Hence, in order for the locking legs 22–25 to move through the passages 26–29, they must flex inwardly so that the outer edges of the locking steps S (the toes of the feet 22A–25A) can clear the juncture of the tapered outer walls of the passages 26–29 with the locking shoulders L. Then the legs 22–25 are free to flex outwardly again to substantially their relaxed positions, thereby engaging the locking steps S with the locking shoulders L.

Figure 3:
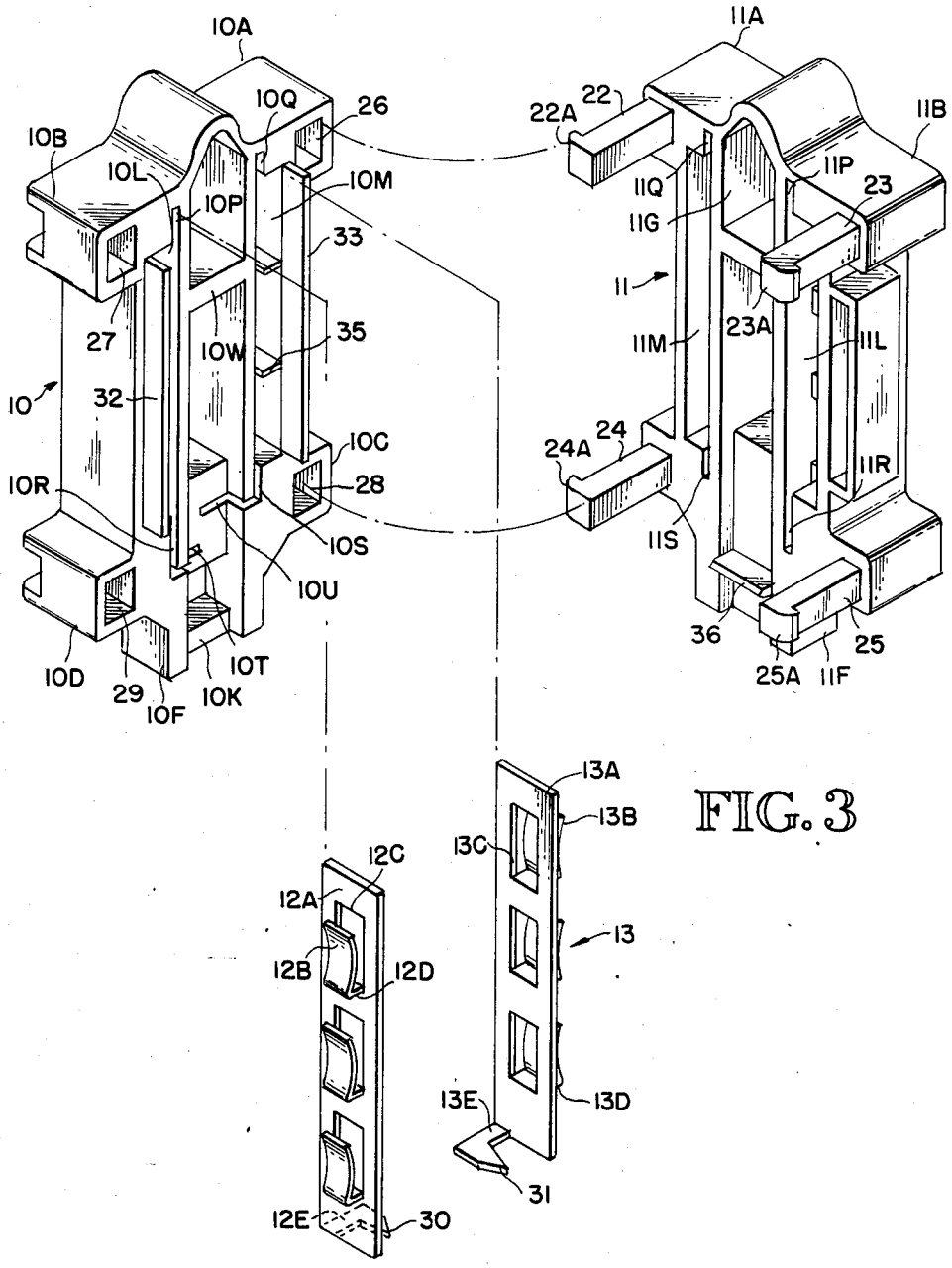
FIG. 3 is an exploded perspective view of the components making up the end connector.

As best seen in FIG. 3, the connector members 12, 13, comprise primary flat strip portions 12A, 13A from which three contact elements 12B and 13B have been formed by punch outs leaving rectangular cutouts 12C and 13C, respectively. Contact elements 12B, 13B are slightly arched toward the cutouts and are spaced therefrom by way of short support bracket elements 12D, 13D. At their foot ends the contact members 12, 13 present upwardly projecting piercing elements 30, 31, which extend integrally from inwardly extending arm extensions 12E, 13E of the contact members. The spacing of the three contact elements 12B from the main body 12A of the contact member 12 and the spacing of the three contact elements 13B from the main body 13A of the contact member 13 approximate the thickness of the blades of standard electrical plugs to be used in conjunction with the connector of the invention.

Directing attention to the bottom shell 10, it will be seen that along its longitudinal outer portion it has an upper cavity 10G, a central cavity 10H, a depressed ledge 10I, a short rear cavity 10J and a rear wall 10K, depressed to the same height as the ledge 10I. The bottom shell also has left and right longitudinal cavities 10L, 10M bordered along their outer sides by upwardly projecting rectangular shielding walls 32, 33, and are preferably provided with spacer baffles 35 which extend inwardly from the outer walls of the cavities and leave a gap between the spacer baffles and the inner walls of the longitudinal cavities 10L, 10M corresponding to the thickness of the main body portions 12A, 13A of the contact members 12, 13. The longitudinal cavities 10L, 10M also have front extensions 10P, 10Q and rear extensions 10R, 10S from which there are inward extensions 10T, 10U extending into the top of the ledge 10I. It will be noted that the extensions 10T, 10U are spaced apart longitudinally of the housing shell 10 and each extend approximately to the longitudinal center line thereof.

Opposing the longitudinal cavities 10L, 10M of the housing shell 10 are longitudinal cavities 11L, 11M formed in the housing shell 11. The latter also has an upper cavity 11G, a central cavity 11H and an elongated ledge 11I, which is arranged to oppose the ledge 10I, the rear cavity 10J and the rear wall 10K of the lower shell 10 when the housing is assembled. It will be noted with the upper shell 11 also has a downwardly projecting diverter flange 36 arranged to extend midway into the rear cavity 10J of the shell 10. The longitudinal cavities 11L, 11M have forward extensions 11P, 11Q opposing the extensions 10P, 10Q when the housing is assembled, and have rear extensions 11R, 11S which oppose the extensions 10R, 10S when the housing is assembled.

Directing attention to FIGS. 3 and 4, it can be seen that the left contact member 12 has its lower half fitting into longitudinal cavity 10L and its extensions 10P and 10Q and that the right connector plate 13 similarly fits in the other cavity 10M and its extensions 10Q, 10S. When the contact members 12, 13 are thus positioned, their contact elements 12B and 13C fit between the spacer baffles 35. It will be apparent that when the two housing shells are mated together the upper halves of the contact members 12, 13 will project upwardly into the longitudinal cavities 11L, 11M and their upper and lower extensions, 11P, 11Q and 11R, 11S and that the piercing elements 30, 31 will project upwardly from the lower ledge 10I to the upper ledge 11I which becomes in effect an anvil.

To assemble the parts of the connector and attach them to a cord 20, the contact members 12, 13 are first fitted into the lower housing shell 10 to the position shown in FIG. 4. Then the cord is positioned so that its free end reaches the divider wall 10W between the forward end of the central cavity 10H and the cavity 10G. The cord then overlies the piercing elements 30, 31. Next, the upper housing shell 11 is lined up with the lower shell 10 with its legs 22–25 entering the passages 26–29 in the lower shell 10, following which the two shells 10, 11 are pressed firmly together until their opposed faces are in contact with one another. This pressure causes the piercing elements 30, 31 to pass through the cord to make contact with the wires therein and to substantially reach the anvil ledge 11I. Also during pressing of the shelves together, the diverting flange 36 causes the cord 20 to bend downwardly into the rear cavity 10J for strain relief to help resist endwise separation of the cord from the connector. This assists the piercing elements 30, 31, which not only make the electrical connection with the cord wires, but also, by passing through the insulation of the cord, resist endwise separation. When the two shells 10, 11 of the connector are together as described, the locking step S of the locking feet 22A–25A by engagement with the locking shoulders L, prevent separation of the shells and the walls 32, 33 shield the connector members 12, 13 at the meeting line of the shells. Also, the ears 11A–D are flush with the ears 10A–D at the start of the legs 22–25 (the meeting line of the shells) so that the ears on the housing shells collectively provide corner ribs having a uniform side configuration, and the bottoms of the feet 22A–25A are located within the confines of the ears 10A–D, as shown in FIG. 1.

When a plug is to be inserted in one of the pairs of socket openings 14–15, 16–17 or 18–19, the blades of the plug pass between their respective contact elements 12B, 13C and the main body 12A, 13A of the contact members 12, 13. The arching of the contact elements 12B assists in making a firm contact and the spacer baffles 35 assist in keeping the central portion of the contact members from being laterally displaced.

It will be apparent from the foregoing description that the connector of the present invention has a minimum of parts and can be readily assembled merely by pressing the two halves 10, 11 of the housing together after the contact elements 12, 13 have been inserted in the lower housing shell. It will also be apparent that good strain relief is provided against endwise separation of the cord from the connector by way of the piercing elements 30, 31 and the operation of the diverter flange 36 cooperating with the rear wall 10K and forward wall of the rear cavity 12J adjoining the ledge 10I.

The crown portions 10E, 11E prevent the use of a three pronged plug in the upper sockets 14–15. As an additional safety feature, the end connector of the present invention can also have a U-shaped side bracket 40 made integral therewith to receive an injection-molded plastic safety cover with a mounting plate 41 having a tapered locking lip 46 which is adapted to be passed through the opening 40*a* defined by the bracket 40 and catch on the upper side thereof. Formed integrally with the mounting plate 41 are a pair of tabs 42, 43 which connect with the mounting plate at hinge portions 44 of reduced thickness. The tabs 42, 43 have plug elements 45 adapted to fit into the socket openings 14, 16 when the tabs are in safety position, thereby preventing accidental insertion of foreign elements into the socket openings 14–17 when only one set of the three sets of socket openings in the connector are being used. The tabs 42–43 are molded at substantially right angles to the mounting plate 41 so as to automatically spring toward the safety position.

From the foregoing it will be appreciated that, although specific embodiments of the invention have been described herein for purpose of illustration, various modifications may be made without deviating from the spirit and scope of the invention. Accordingly, the invention is not limited accept by the appended claims.

I claim:

1. A housing for a multiple-socket end connector, comprising:

two interfitting housing shells each having a set of openings extending through the exterior surface of the shell, each set being adapted to receive two blades of an electrical plug, said shells having spaced elongated pockets arranged to provide two internal elongated cavities communicating with said sets and adapted to receive two parallel conductor members for engagement by the blades of plugs occupying said sets, and said shells having central elongated recesses arranged to jointly provide an externally opening wireway extending between said elongated cavities for receiving an electrical cord;

two pairs of flexible legs projecting integrally from one of said shells near opposite ends thereof, each leg having a laterally extending locking foot at its free end, said legs being arranged to extend through open-ended bores formed in the other shell and having their locking feet engaging retaining shoulders at the outer ends of the bores to prevent withdrawal of the legs from the bores;

each of said bores having a widened mouth portion at its inner end aligned with the respective retaining shoulder for introduction of the locking foot of the respective leg at the start of assembly of the housing, and then tapering inwardly from said mouth portion such as to spring the leg inwardly during assembly until its locking foot reaches the outer end of the bore and springs back outwardly to fit over the respective retaining shoulder.

2. A housing for a multiple-socket end connector according to claim 1 in which the shell having the bores has two pairs of ears through which the bores extend.

3. A housing for a multiple-socket end connector according to claim 2 in which the shell with the legs has two pairs of ears from which said legs project which are arranged to align with the ears on the shell having the bores.

4. A housing for a multiple-socket end connector according to claim 2 in which, when the housing shells interfit, the bottoms of the feet are exposed and the feet are confined within the periphery of the ears having the bores.

5. A housing for a multiple-socket end connector according to claim 1 in which one of said housing shells has two of said sets of openings and the other shell has one of said sets located between said two sets.

6. A housing for a multiple-socket end connector according to claim 1 in which the bottom of each locking foot is sloped from a heel portion of the foot to a toe portion of the foot, and the toe portion is arranged to fit over a said respective retaining shoulder.

7. A housing for a multiple-socket end connector according to claim 6 in which the toe portions of the feet of each pair of feet extend away from one another.

8. A housing for a multiple-socket end conenctor according to claim 1 in which one of said shells has a pair of elongated parallel shielding walls projecting thereform and arranged to extend into the said elongated cavity of the other shell.

9. A housing for a multiple-socket end connector according to claim 1 in which one of said shells has a stop wall arranged as a stop for the end of an electrical cord in the wireway.

10. A housing for a multiple-socket end connector according to claim 9 in which one of said shells has a cord diverter wall arranged to project into the central elongated recess of the other wall in spaced relation to said stop wall.

11. A housing for a multiple-socket end connector according to claim 1 in which one of said shells has its pockets formed with inturned extensions which intersect the central elongated recess of the shell located in spaced-apart relationship from one another lengthwise of such central elongated recess for receiving extensions of the conductor members which provide cord piercing elements projecting into the wireway.

12. A multiple-socket end connector comprising:

two injection-molded plastic housing shells having integral means for snap-fitting them together to form a housing, said housing having a central wireway, two elongated cavities on opposite sides of the wireway, and multiple sets of openings, two openings per set, through the shells from the exterior surfaces thereof into the two cavities for receiving plug blades, and said shells having extensions of said cavities extending into said wireway;

said integral means for snap-fitting the housing shells together comprising two pairs of flexible legs projecting integrally from one of said shells near opposite ends thereof, each leg having a laterally extending locking foot at its free end, said legs extending through open-ended bores formed in the other shell and having their locking feet engaging retaining shoulders at the outer ends of the bores to prevent withdrawal of the legs from the bores;

each of said bores having a widened mouth portion at its inner end aligned with the respective retaining shoulder for introduction of the locking foot of the respective leg at the start of assembly of the housing, and then tapering inwardly from said mouth portion such as to spring the leg inwardly during assembly until its locking foot reaches the outer end of the bore and springs back outwardly to fit over the respective retaining shoulder; and two elongated conductor members in said elongated cavities and occupying said cavity extensions, said conductor members presenting integral cord piercing barbs projecting into said wireway at locations spaced apart lengthwise of the wireway and laterally thereof for making electrical contact with respective wires in an electrical cord positioned in said wireway when the housing shells are snap-fitted together, said conductor members also having integral contact elements arranged to be engaged by plug blades inserted through said sets of openings.

13. An end connector according to claim 12 in which the housing shell having the bores has two pairs of ears through which the bores extend.

14. An end connector according to claim 12 in which the shell with the legs has two pairs of ears from which said legs project which are arranged to align with the ears on the shell having the bores.

15. An end connector according to claim 12 in which said contact members each have a flat main body portion in the respective elongated cavity and contact elements struck out of said main body, leaving cutouts therein, said contact elements opposing said cutouts and arching toward them in spaced relation to said main body portion, and said contact elements being arranged to engage plug blades introduced between the contact elements and said main body portion through said sets of openings.

* * * * *

UNITED STATES PATENT AND TRADEMARK OFFICE

CERTIFICATE OF CORRECTION

PATENT NO. : 4678257

DATED : July 7, 1987

INVENTOR(S) : Joseph M. Ahroni

It is certified that error appears in the above—identified patent and that said Letters Patent is hereby corrected as shown below:

In the claims:

Col. 5, line 25 before "blades" add --substantially flat--

Col. 6, line 9 change "conenctor" to --connector--

Col. 6, line 12 change "thereform" to --therefrom--

Col. 6, line 38 change "surfaces" to --surface--

Col. 6, line 39 before "plug blades" add --substantially flat--.

Signed and Sealed this

Twenty-third Day of February, 1988

*Attest:*

DONALD J. QUIGG

*Attesting Officer*

*Commissioner of Patents and Trademarks*